US006366538B1

(12) United States Patent
Anderson et al.

(10) Patent No.: US 6,366,538 B1
(45) Date of Patent: Apr. 2, 2002

(54) INTERFERENCE STRUCTURE FOR EMERGENCY RESPONSE SYSTEM WRISTWATCH

(75) Inventors: Jill Anderson; Brian Boling; Thomas Natale, all of Knoxville, TN (US)

(73) Assignee: SecureAlert, Inc., Knoxville, TN (US)

( * ) Notice: Subject to any disclaimer, the term of this patent is extended or adjusted under 35 U.S.C. 154(b) by 0 days.

(21) Appl. No.: 09/651,523

(22) Filed: Aug. 29, 2000

(51) Int. Cl.[7] ..... G04B 37/00

(52) U.S. Cl. ..... 368/10; 368/47; 368/281; 368/276; 368/283

(58) Field of Search ..... 368/10, 47, 281, 368/282, 276, 283, 286, 309–313

(56) References Cited

U.S. PATENT DOCUMENTS

| | | | | |
|---|---|---|---|---|
| 1,954,249 | A | * | 4/1934 | Kehl |
| 4,168,607 | A | | 9/1979 | Friedman |
| 4,964,093 | A | | 10/1990 | Hiranuma et al. |
| 5,102,023 | A | | 4/1992 | Nguyen |
| D329,201 | S | | 9/1992 | Barat |
| 5,652,736 | A | | 7/1997 | Lee |

OTHER PUBLICATIONS

Magnavox Security, Living Safely Without Sacrificing Your Independence, Magnavox SecureWatch™ product brochure.

* cited by examiner

*Primary Examiner*—Bernard Roskoski
(74) *Attorney, Agent, or Firm*—Luedeka, Neely & Graham, P.C.

(57) ABSTRACT

An emergency response system wristwatch having upper and lower case sections connected by a hinge is combined with a removable interference bracket disposed between the two case sections. The upper case section has opposing rear and front surfaces, where the front surface includes a dial face. The upper case section is operable to pivot on the hinge between open and closed positions. The lower case section has an activation button that is exposed when the upper case section is in the open position. When the upper case section is in the closed position, the rear surface of the upper case section is disposed adjacent the activation button. Without the removable interference bracket between the upper and lower case sections, the rear surface of the upper case section is operable to move toward the lower case section and press upon the activation button if pressure is applied to the dial face. Housed within the lower case section is a wireless transmitter that is activated when the rear surface of the upper case section presses the activation button. When activated, the wireless transmitter transmits a wireless emergency signal. When the removable interference bracket is installed between the upper and lower case sections, the bracket prevents the rear surface of the upper case section from pressing the activation button if pressure is applied to the dial face. Thus, the interference bracket prevents accidental activation of the wireless transmitter due to inadvertent pressure upon the dial face.

12 Claims, 10 Drawing Sheets

(Section A-A of Fig. 2)

(Section B-B of Fig. 4)

(Section C-C of Fig. 7)

(Section D-D of Fig. 9)

INTERFERENCE STRUCTURE FOR EMERGENCY RESPONSE SYSTEM WRISTWATCH

TECHNICAL FIELD

The present invention is generally directed to improvements in portable emergency response system transmitter units. More particularly, the invention is directed to a device for preventing inadvertent activation of an emergency response system transmitter in an emergency response system wristwatch.

BACKGROUND OF THE INVENTION

Emergency response systems are used to signal for help in the event of a medical or other type of emergency. Generally, these systems include a portable wireless transmitter small enough to fit within a pendent so that it may be easily carried by a user. Such systems also typically include a separate receiving unit connected to a telephone line. If the user experiences a medical emergency and needs assistance, the user activates the portable transmitter by pressing an activation button or other surface on the pendent. Upon activation, the transmitter transmits a wireless signal to the receiving unit. Upon receipt of the wireless signal, the receiving unit automatically places a telephone call to a monitoring service.

Although such systems have been quite effective in summoning help for many users in emergency situations, some users have experienced problems. For some users, the problem is accidental activation of the portable transmitter by inadvertent contact with the activation button which causes a false alarm.

An improvement to the portable wireless transmitter is needed to prevent accidental activation of the transmitter due to inadvertent contact with the activation button, while maintaining ease of activation in stressful emergency situations.

SUMMARY OF THE INVENTION

The foregoing and other needs are met by an emergency response system wristwatch having two case sections combined with a removable interference bracket disposed between the two case sections. The case sections include a lower case section attached to a watchband and an upper case section attached to the lower case section by a hinge. The upper case section has a rear surface and a front surface, where the front surface includes a dial face. The upper case section is operable to swing on the hinge between open and closed positions. The lower case section has an activation button that is exposed when the upper case section is in the open position. When the upper case section is in the closed position, the rear surface of the upper case section is adjacent the activation button.

Without the interference bracket between the upper and lower case sections, the rear surface of the upper case section is operable to move toward the lower case section and press upon the activation button when pressure is applied to the dial face. Housed within the lower case section is a wireless transmitter that is activated when the rear surface of the upper case section presses the activation button. When activated, the wireless transmitter transmits a wireless emergency signal.

When the interference bracket is installed between the upper case section and the lower case section, the bracket prevents the rear surface of the upper case section from pressing the activation button if pressure is applied to the dial face. Thus, the interference bracket prevents accidental activation of the wireless transmitter due to inadvertent pressure upon the dial face.

In preferred embodiments, the interference bracket includes a tab for contacting the lower case section when the upper case section is in the closed position. The contacting of the tab against the lower case section prevents further movement of the upper case section toward the lower case section when pressure is applied to the dial face. In some embodiments, the tab extends outwardly from between the upper and lower case sections, and has an exposed lower surface upon which pressure may be applied to lift the upper case section toward the open position.

In another aspect, the invention provides a combination personal time-keeping device and emergency signaling device that includes a lower case section, an upper case section rotationally attached to the lower case section, and an interference structure. The lower case section, which houses a wireless emergency transmitter, has an upper surface with a transmitter activation button mounted therein. The transmitter is activated by pressure upon the transmitter activation button. The upper case section has a rear surface and an opposing front surface that includes a dial face. The upper case section is movable relative to the lower case section from a closed position to an open position. In the closed position, the rear surface of the upper case section is disposed adjacent the activation button, such that pressure applied to the dial face causes the rear surface of the upper case section to move toward the activation button. The interference structure prevents the rear surface of the upper case section from pressing the activation button when pressure is applied to the dial face, thereby preventing inadvertent activation of the transmitter.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
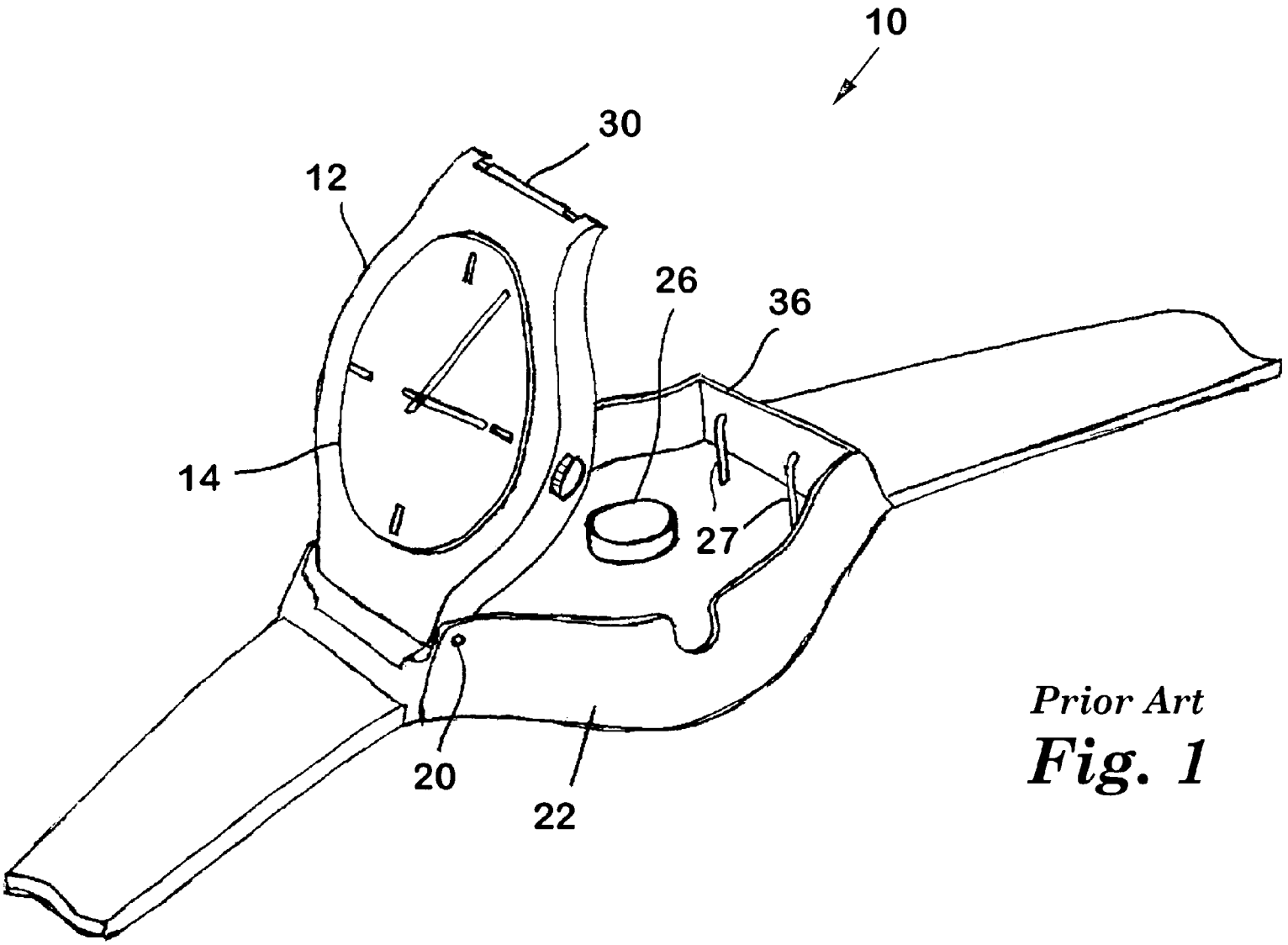
Prior Art Fig. 1
FIG. 1 is a perspective view of an emergency response system wristwatch.
Figure 2:
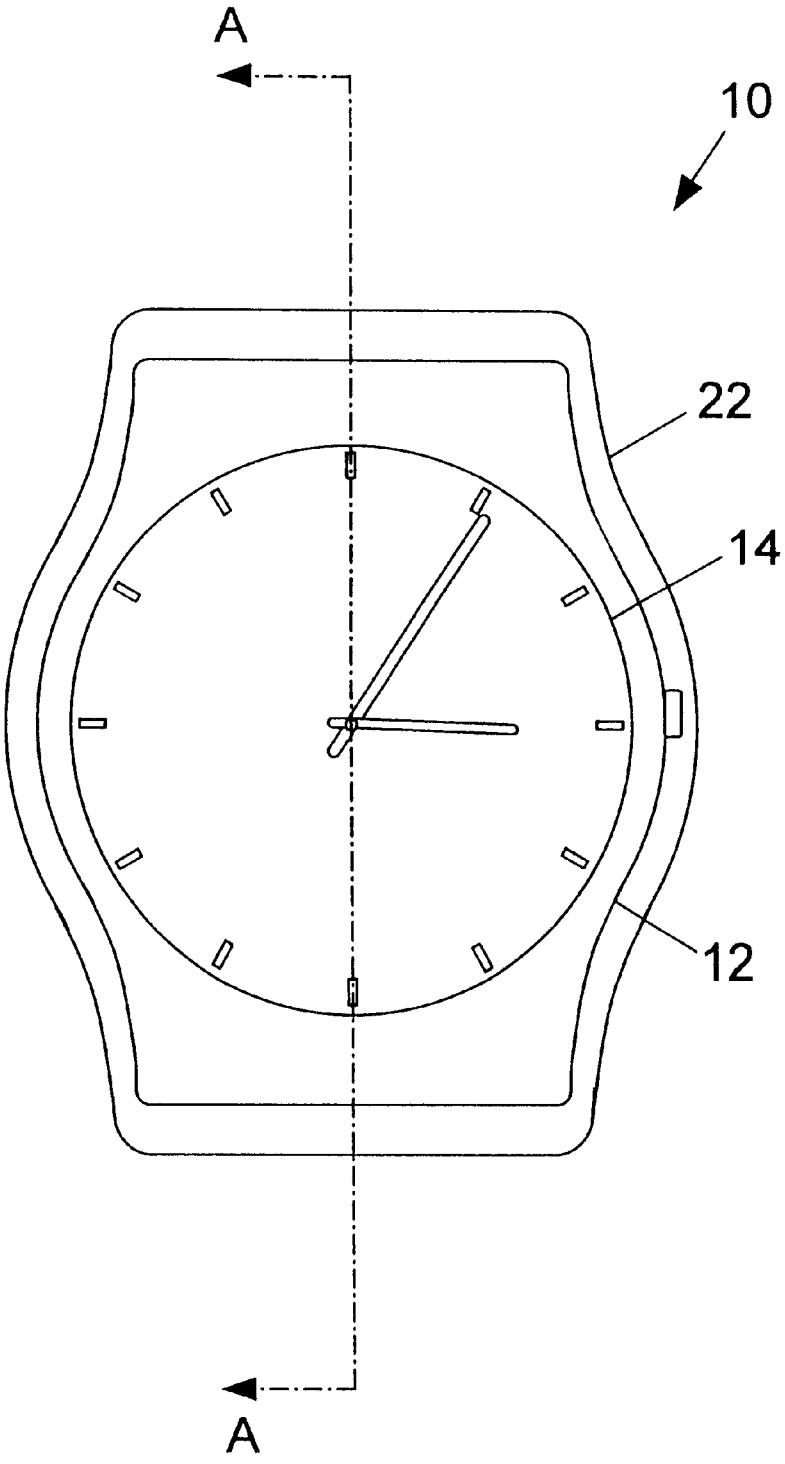
Prior Art Fig. 2
FIG. 2 is a front view of an emergency response system wristwatch.
Figure 3:
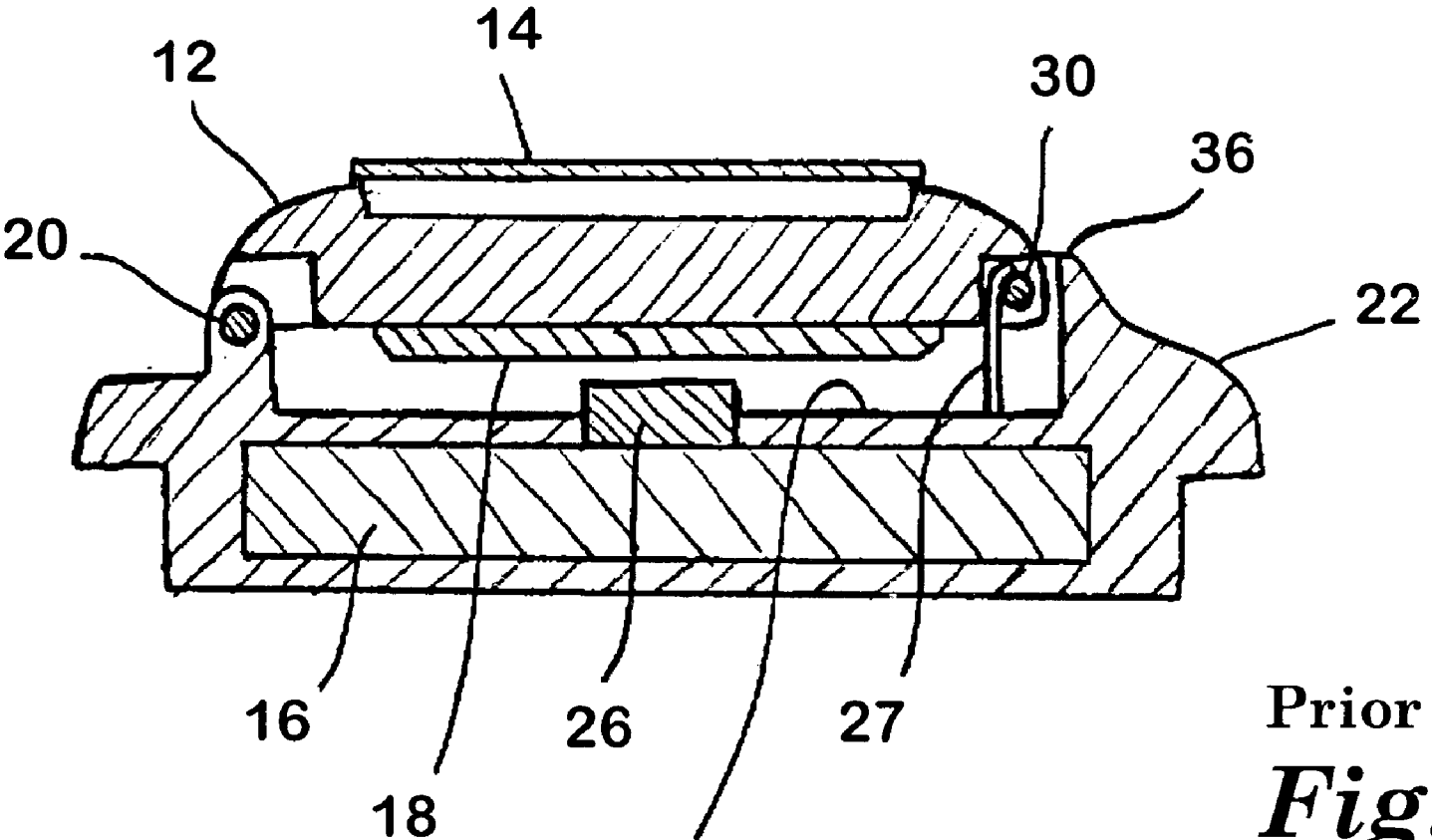
Prior Art Fig. 3
FIG. 3 is a cross-sectional view of the emergency response system wristwatch of FIG. 2.

Shown in FIGS. 1, 2, and 3 is an emergency response system wristwatch 10. The wristwatch 10 includes an upper case section 12 housing a time-keeping device. The upper case section 12 has a front surface that includes a dial face 14, and an opposing rear surface that includes a removable case cover 18. The upper case section 12 is attached by a hinge 20 to a lower case section 22. The upper case section 12 is operable to pivot about the hinge 20 from an open position (as shown in FIG. 1) to a closed position (as shown in FIGS. 2 and 3).

The lower case section 22 houses a miniature wireless transmitter 16 for transmitting wireless emergency signals to a receiving unit. In an upper surface 24 of the lower case section 22 is a transmitter activation button 26. When pressure is applied to the activation button 26, the wireless transmitter 16 within the lower case section 22 is activated to transmit the wireless emergency signals to the receiving unit.

FIG. 3 depicts a cross-sectional view of the wristwatch 10 taken at section A—A as depicted in FIG. 2. As shown in FIG. 3, when the upper case section 12 is in the closed position, the rear surface of the upper case section 12 is disposed immediately adjacent the activation button 26. In this position, if pressure is applied to the dial face 14, the rear surface of the upper case section 12 moves toward the lower case section 22 and presses against the activation button 26. This pressure upon the activation button 26 causes activation of the transmitter 16. Thus, the version of the wristwatch 10 shown in FIG. 3 allows a user to activate the wireless transmitter 16 by pressing on the dial face 14.

As shown in FIGS. 1 and 3, a pair of prongs 27 extend vertically from the top surface 24 of the lower case section 22. The prongs 27 are provided to retain the upper case section 12 in the closed position. The ends of the prongs 27 are curved slightly outward, such that when the upper case section 12 is in the closed position, the ends of the prongs 27 press against a push-pin 30 which spans one end of the upper case section 12. When sufficient upward force is applied to the upper case section 12 to move it toward the open position, the prongs 27 may flex slightly inward to allow the push-pin 30 to slide past the prongs 27.

One problem experienced by users of the emergency wristwatch 10 is accidental activation of the transmitter 16 due to inadvertent pressure upon the dial face 14. Such pressure is likely to occur due to the location in which the wristwatch 10 is typically worn. Movements of the user may inadvertently cause the face of the wristwatch 10 to press against the arm of a chair, against another part of the user's body, or against the user's shirt or jacket sleeve, thereby causing accidental activation of the transmitter 16. The invention described herein addresses this and other problems related to the wristwatch 10.

Figure 4:
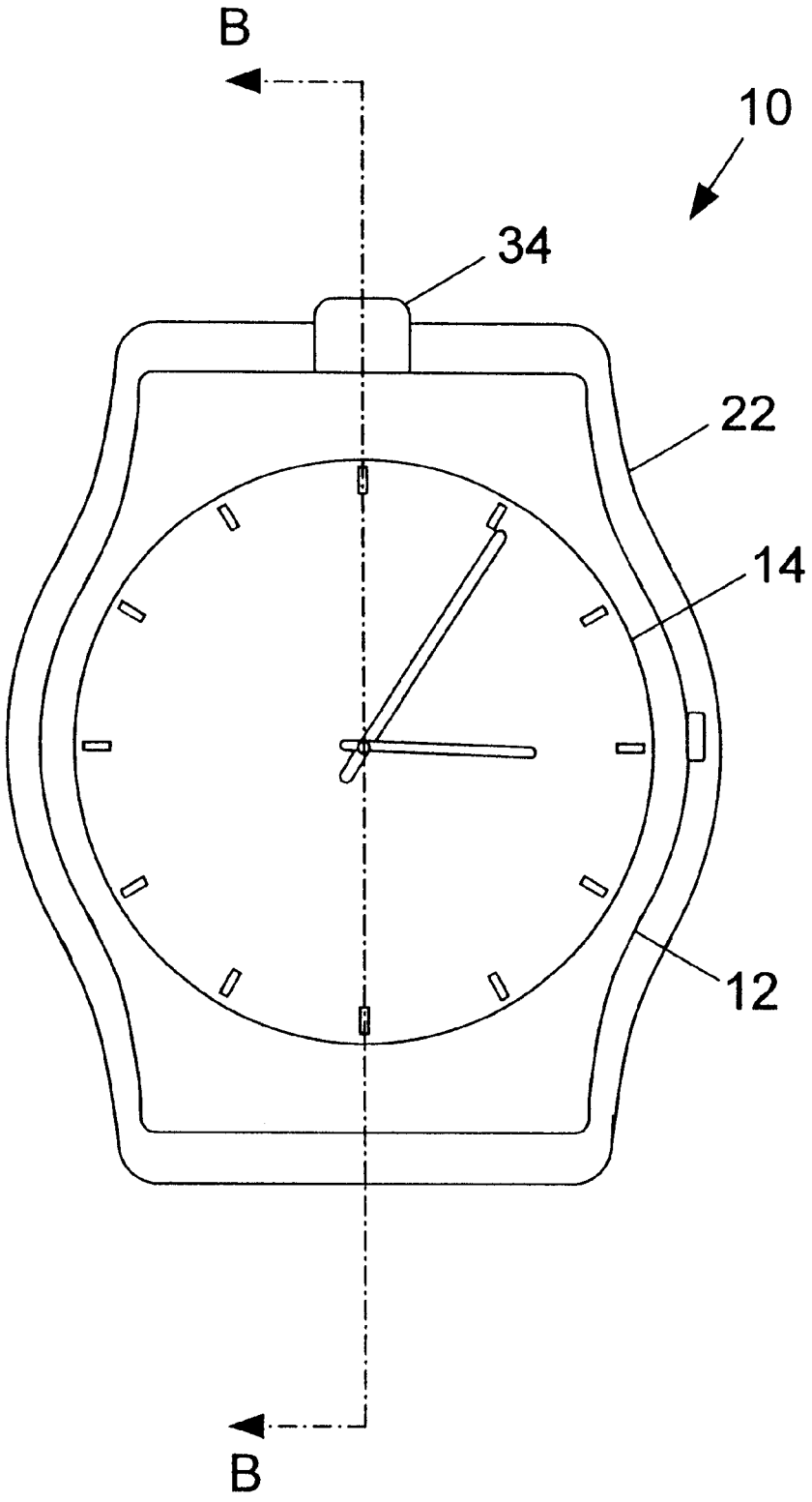
FIG. 4 is a front view of a combination emergency response system wristwatch and interference bracket according to a preferred embodiment of the invention.
Figure 5:
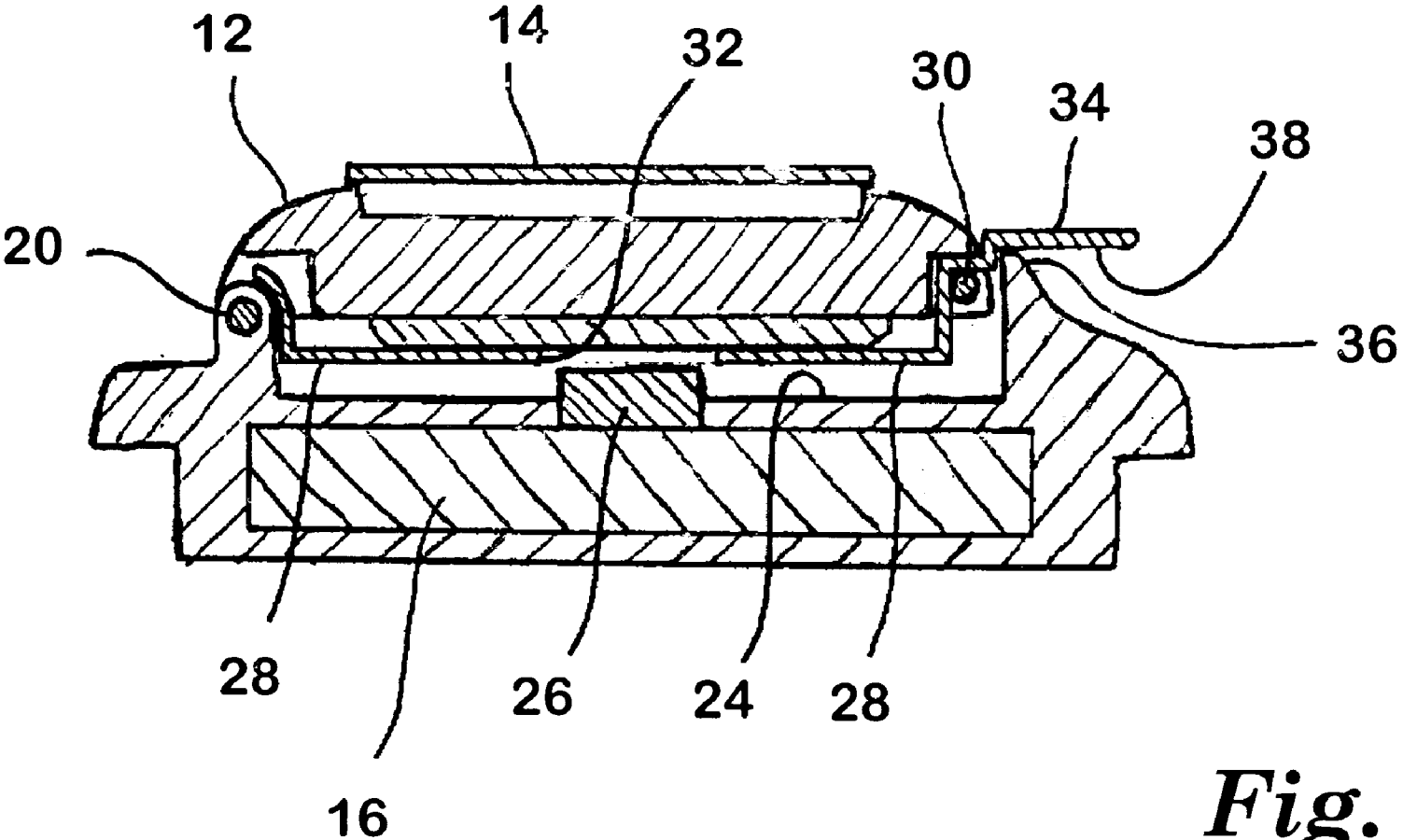
FIG. 5 is a cross-sectional view of the combination emergency response system wristwatch and interference bracket of FIG. 4.

FIGS. 4 and 5 show a preferred embodiment of the invention, in which the wristwatch 10 is combined with a removable interference bracket 28 disposed between the upper case section 12 and the lower case section 22. As described in more detail herein, one function of the bracket 28 is to prevent the rear surface of the upper case section 12 from contacting the activation button 26 if pressure is applied to the dial face 14. Another function of the bracket 28 is to provide a means for lifting the upper case section 12 from the closed position to the open position, thereby exposing the activation button 26.

FIG. 5 depicts a cross-sectional view of the wristwatch 10 taken at section B—B as depicted in FIG. 4. In the preferred embodiment of the invention as shown in FIG. 5, the bracket 28 is attached to the upper case section 12 by inserting one end of the bracket 28 between the hinge 20 and a portion of the upper case section 12 adjacent the hinge 20. The other end of the bracket 28 is held in place against the rear surface of the upper case section 12 by the push-pin 30. Preferably, the bracket 28 includes an aperture 32 of sufficient size to provide clearance between the activation button 26 and the bracket 28 when the upper case section 12 is in the closed position.

The bracket 28 includes an outwardly-extending tab 34 that is substantially parallel to the front and rear surfaces of the upper case section 12 when the bracket 28 is attached to the upper case section 12. As shown in FIG. 5, when the upper case section 12 is in the closed position, the tab 34 contacts a rim 36 of the lower case section 22. The contact of the tab 34 against the rim 36 prevents further movement of the upper case section 12 toward the lower case section 22 if pressure is applied to the dial face 14. In this manner, the tab 34 of the bracket 28 serves as an interference structure for preventing the rear surface of the upper case section 12 from pressing against the activation button 26 and causing inadvertent activation of the transmitter 16 if pressure is applied to the dial face 14.

When the upper case section 12 is in the closed position, the tab 34 extends over the lower case section 22. Preferably, the portion of the tab 34 extending over the lower case section 22 is about 0.22 inch long. This portion of the tab 34 extending over the lower case section 22 has an exposed lower surface 38 upon which pressure may be applied to lift the upper case section 12 toward the open position. Thus, when the upper case section 12 is in the closed position, a user may simply lift up on the lower surface 38 of the tab 34 to lift the upper case section 12 and expose the activation button 26. The user may then activate the transmitter 16 by pressing directly on the exposed activation button 26.

Figure 6B:
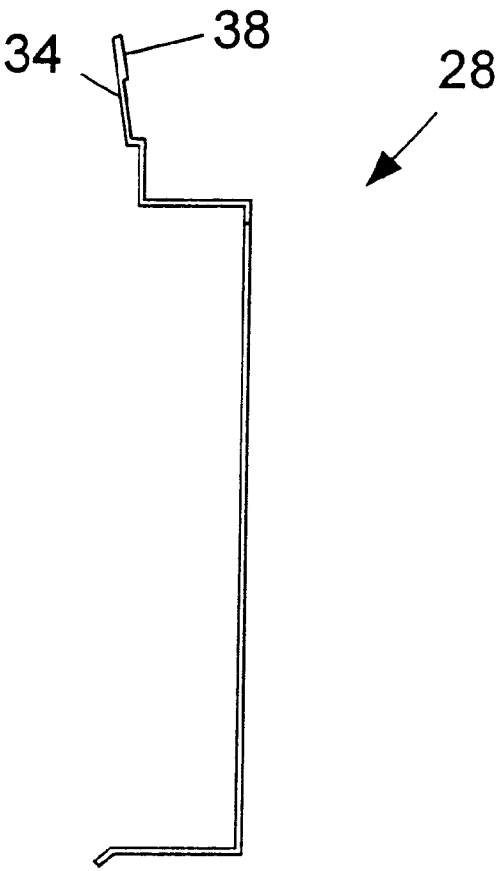
FIG. 6B is a side view of the interference bracket according to a preferred embodiment of the invention.
Figure 6A:
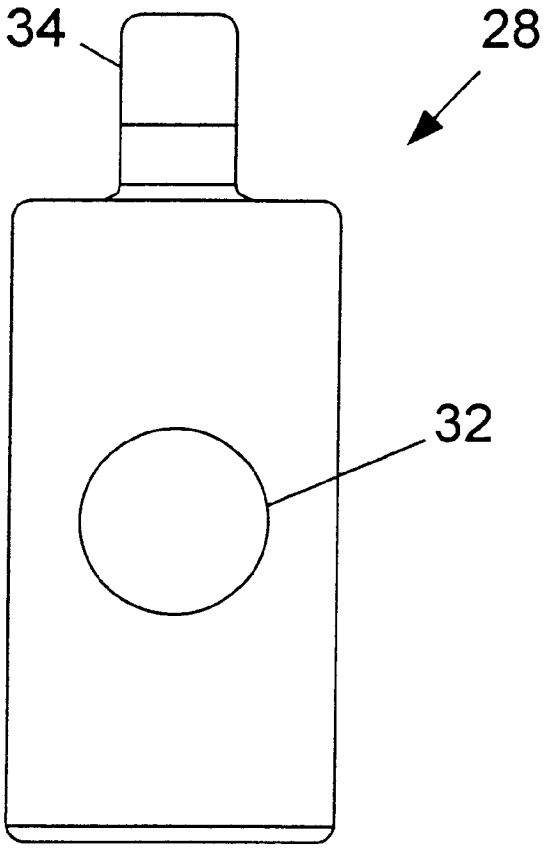
FIG. 6A is a front view of an interference bracket according to a preferred embodiment of the invention.

FIGS. 6A and 6B show two views of the preferred embodiment of the bracket 28.

It will be appreciated that the design of the bracket 28 provides for easy removal of the bracket 28 should the user wish to be able to activate the transmitter 16 by pressing on the dial face 14. To remove the bracket 28, the user simply (1) removes the push-pin 30, (2) pulls the bracket 28 outward from the upper case section 12 by rotating the bracket 28 on the hinge 20, and (3) pulls the bracket 28 out from between the hinge 20 and the upper case section 12. Installation of the bracket 28 is accomplished by the reversal of those three steps.

Figure 7:
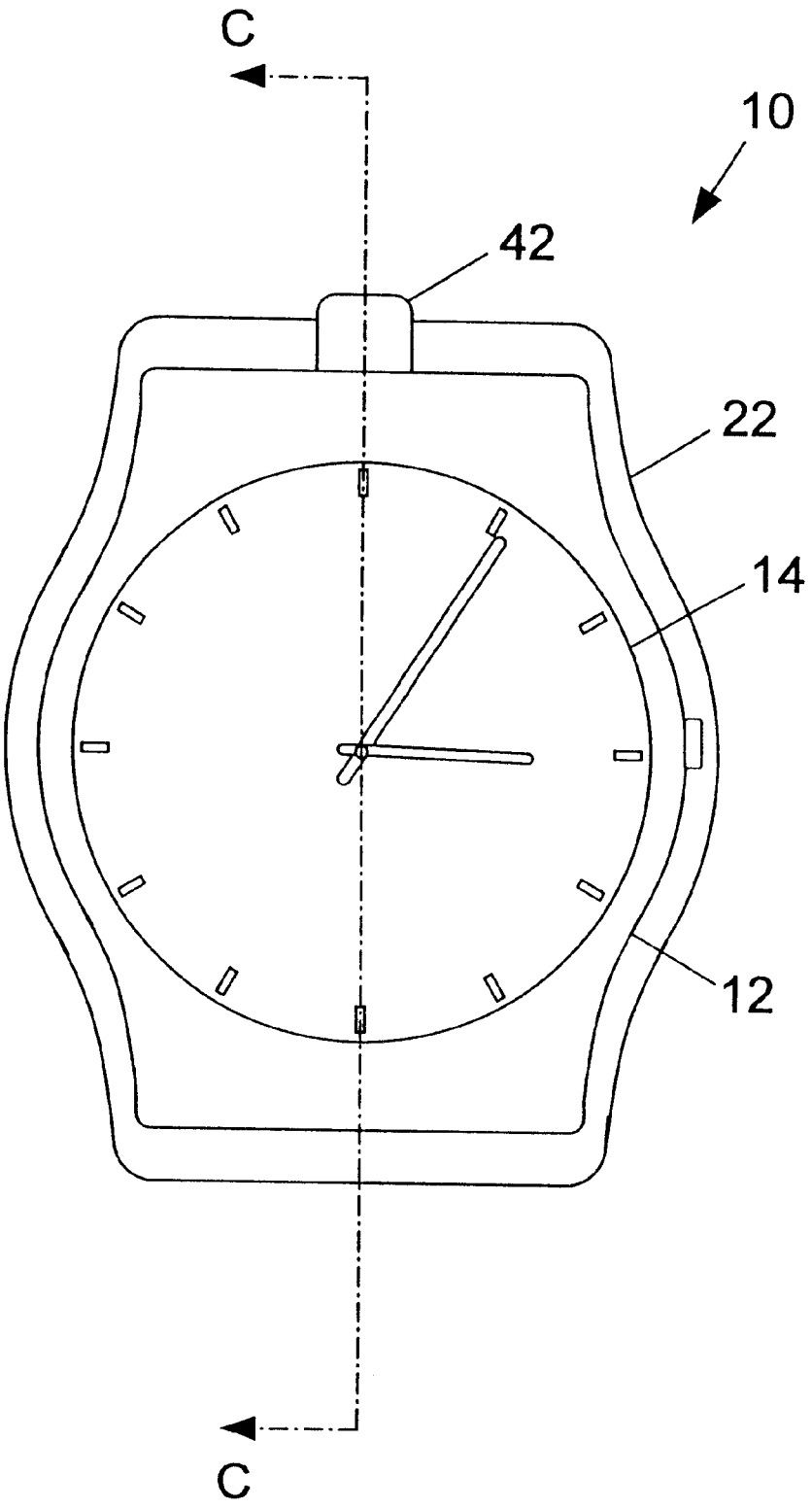
FIG. 7 is a front view of an emergency response system wristwatch with an interference structure according to a first alternative embodiment of the invention.
Figure 8:
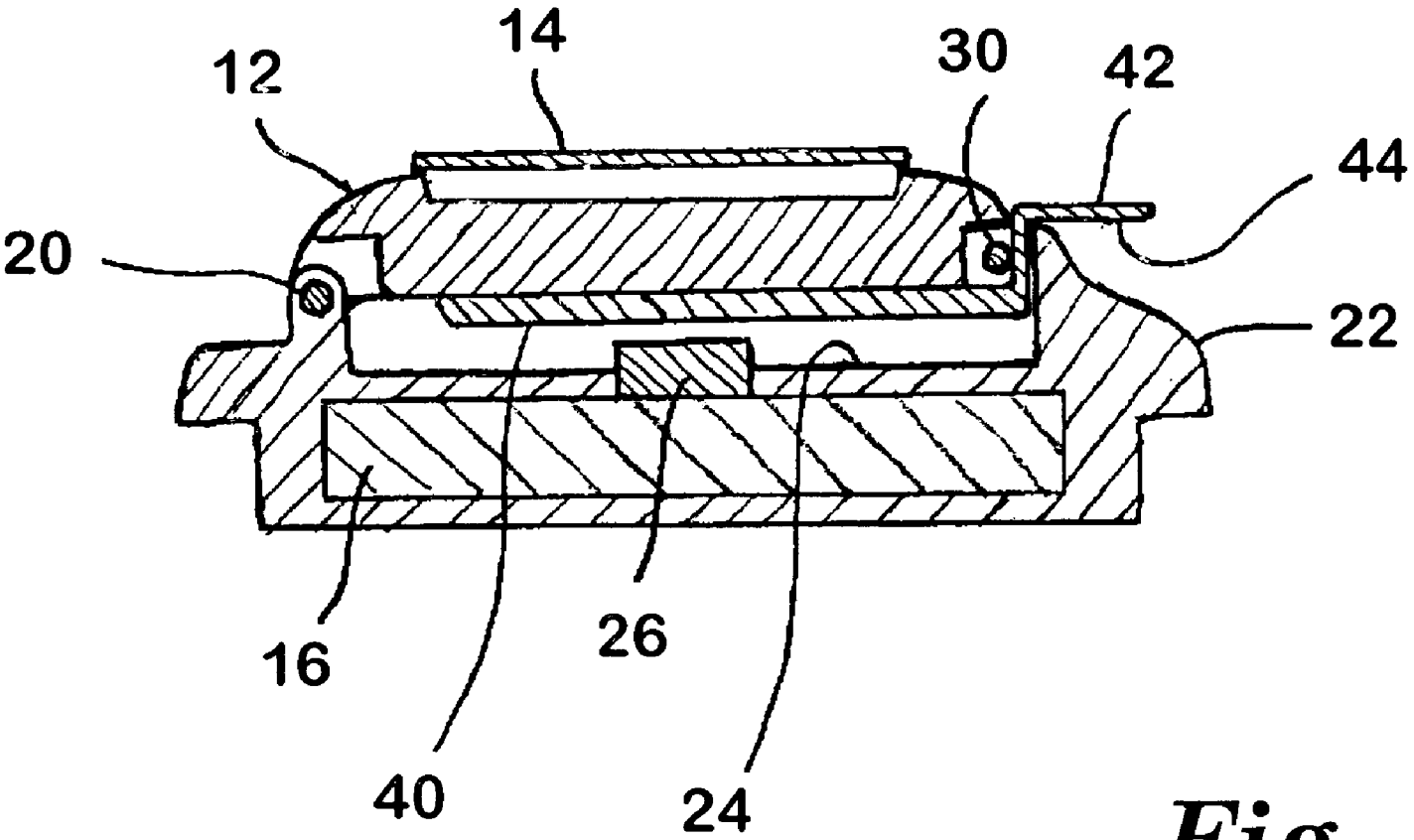
FIG. 8 is a cross-sectional view of the emergency response system wristwatch of FIG. 7.

In an alternative embodiment of the invention, as shown in FIGS. 7 and 8, the upper case section 12 has a removable back cover 40 that includes a tab 42 extending outwardly from an edge of the cover 40. Preferably, the tab 42 and the removable back cover 40 are molded as a single piece. Alternatively, the tab 42 may be attached to the removable back cover 40 by an adhesive or other type of fastener. When the upper case section 12 is in the closed position, the tab 42 contacts the rim 36 of the lower case section 22, thereby preventing further movement of the upper case section 12 toward the lower case section 22 when pressure is applied to the dial face 14. In this embodiment, the tab 42 of the back cover 40 serves as an interference structure for preventing the rear surface of the upper case section 12 from pressing against the activation button 26 and causing activation of the transmitter 16 if pressure is applied to the dial face 14.

Preferably, when the upper case section 12 is in the closed position, the tab 42 extends over the lower case section 22 by about 0.22 inch. This portion of the tab 42 extending over the lower case section 22 has an exposed lower surface 44 upon which pressure may be applied to lift the upper case section 12 toward the open position. With this embodiment, the user may lift up on the lower surface 44 of the tab 42 to lift the upper case section 12 and expose the activation button 26.

Should the user wish to be able to activate the transmitter 16 by pressing on the dial face 14, the back cover 40 having the tab 42 may be removed and replaced with a back cover that has no interference structure, such as the back cover 18 shown in FIG. 3. In this way, the alternative embodiment of the invention depicted in FIGS. 7 and 8 may be easily converted to operate according to the prior art wristwatch depicted in FIGS. 1–3.

Figure 9:
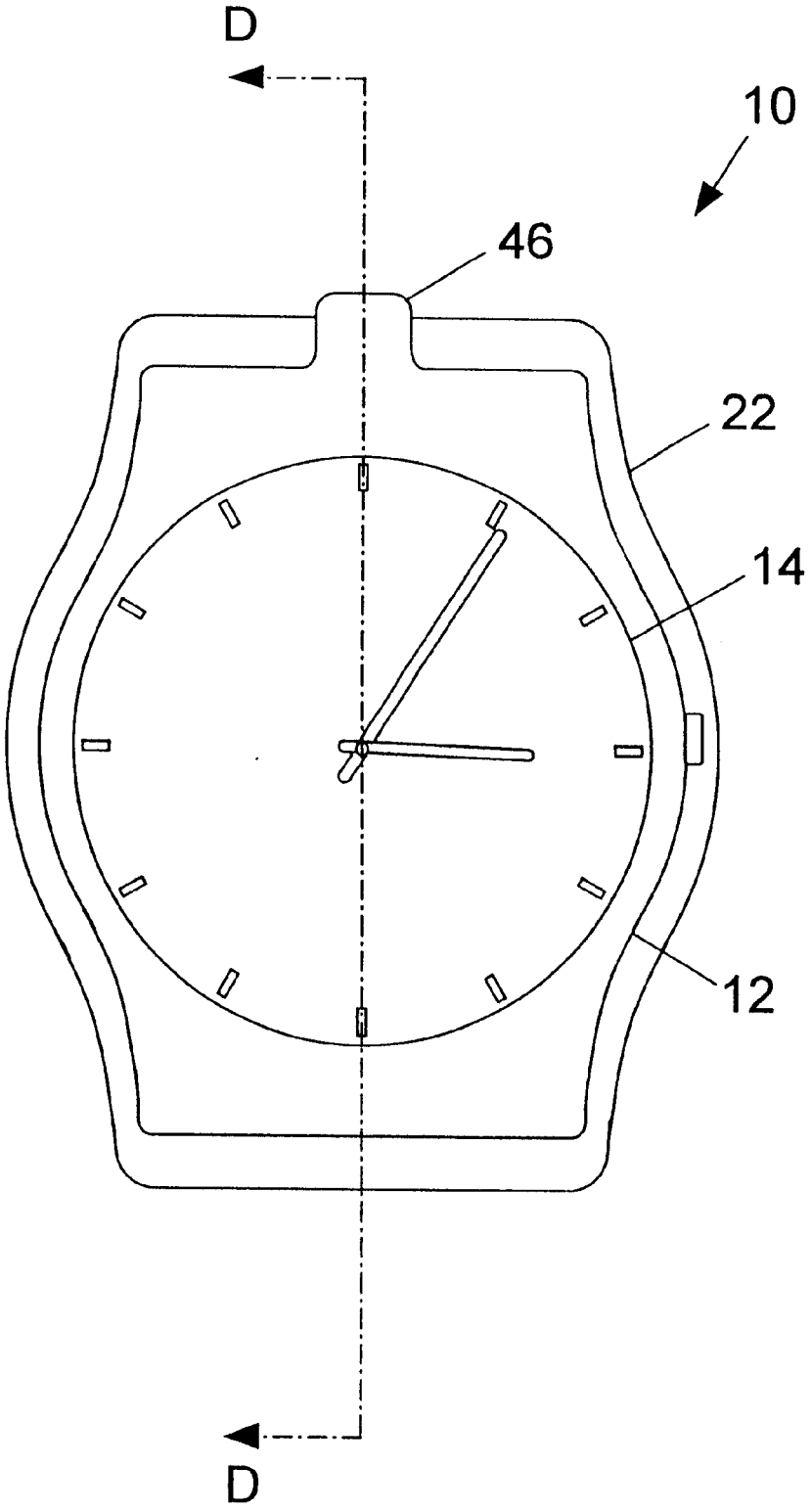
FIG. 9 is a front view of a n emergency response system wristwatch with an interference structure according to a second alternative embodiment of the invention.
Figure 10:
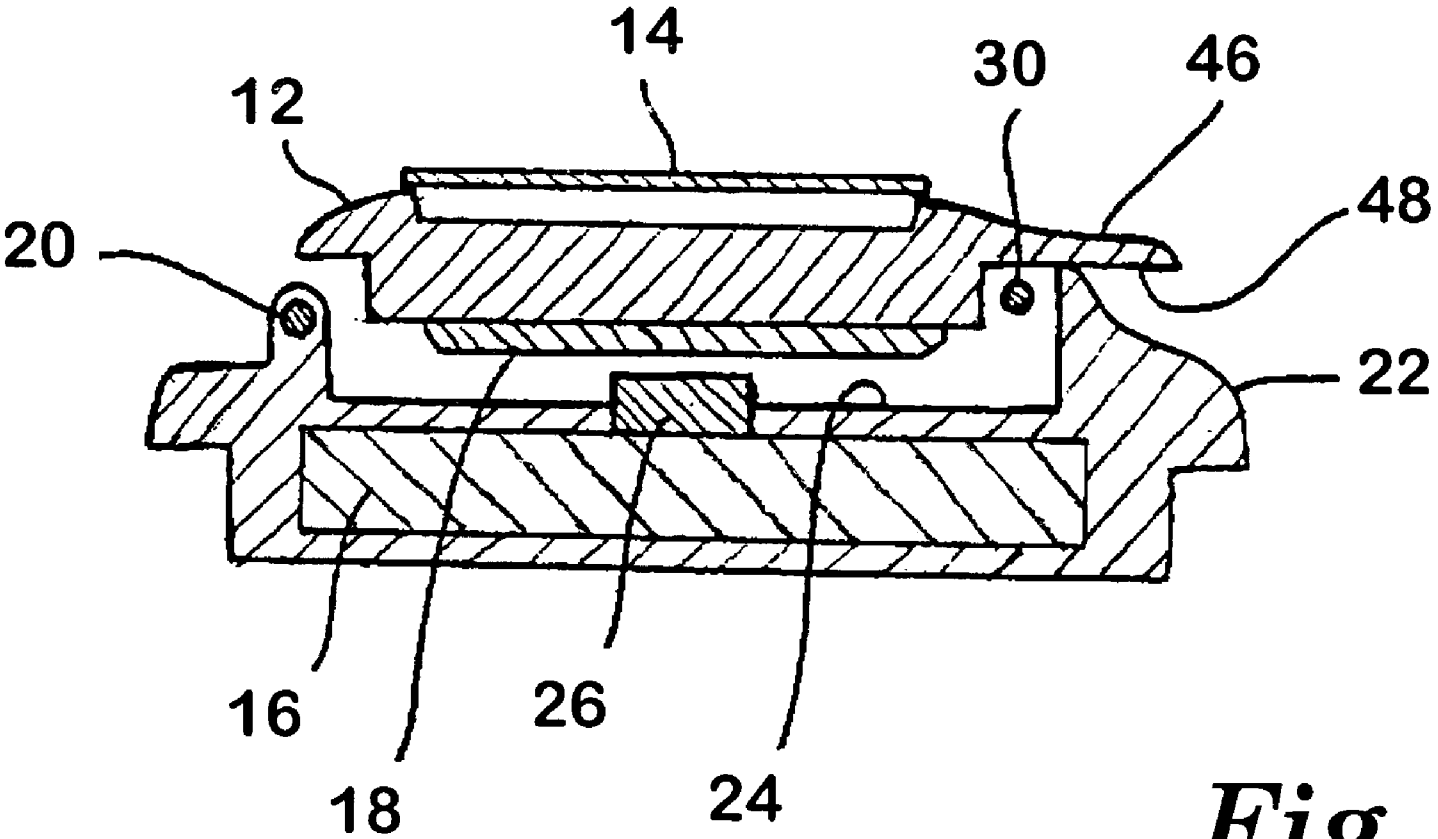
FIG. 10 is a cross-sectional view of the emergency response system wristwatch of FIG. 9.

In yet another embodiment of the invention, as shown in FIGS. 9 and 10, the upper case section 12 includes an integral tab 46 extending outwardly from an edge of the upper case section 12. Preferably, the tab 46 and the upper case section 12 of this embodiment are molded as a single piece. Alternatively, the tab 46 may be attached to the upper case section 12 by an adhesive or other type of fastener. When the upper case section 12 is in the closed position, the tab 46 contacts the rim 36 of the lower case section 22, thereby preventing further movement of the upper case section 12 toward the lower case section 22 when pressure is applied to the dial face 14. In this embodiment, the tab 46 extending from the upper case section 12 serves as an interference structure for preventing the rear surface of the upper case section 12 from pressing against the activation button 26 and causing activation of the transmitter 16 when pressure is applied to the dial face 14.

When the upper case section 12 is in the closed position, the tab 46 preferably extends over the lower case section 22 by approximately 0.22 inch. The portion of the tab 46 that extends over the lower case section 22 has an exposed lower surface 48. A user may apply upward pressure to the surface 48 to lift the upper case section 12 toward the open position to expose the activation button 26.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. In a wristwatch having two case sections, including a lower case section attached to a watchband and an upper case section attached to the lower case section by a hinge, the upper case section having a rear surface and an opposing front surface, the front surface comprising a dial face, the upper case section operable to swing on the hinge between open and closed positions, the lower case section having an activation button that is exposed when the upper case section is in the open position, the rear surface of the upper case section disposed adjacent the activation button when the upper case section is in the closed position, the rear surface of the upper case section operable to move toward the activation button when pressure is applied to the dial face, the lower case section housing a wireless transmitter operable to be activated by the activation button when the rear surface of the upper case section presses the activation button, the wireless transmitter for transmitting a wireless emergency signal when activated, the combination of the wristwatch with a removable interference bracket disposed between the upper case section and the lower case section, the bracket for preventing the rear surface of the upper case section from pressing against the activation button when pressure is applied to the dial face, thereby preventing inadvertent activation of the wireless transmitter.

2. The combination of claim 1 wherein the bracket includes a tab for contacting the lower case section when the upper case section is in the closed position, the contacting of the tab against the lower case section preventing further movement of the upper case section toward the lower case section when pressure is applied to the dial face.

3. The combination of claim 2 wherein the tab extends outwardly from between the upper case section and the lower case section, the tab having an exposed lower surface upon which pressure may be applied to lift the upper case section toward the open position.

4. In a wristwatch having two case sections, including a lower case section attached to a watchband and an upper case section attached to the lower case section by a hinge, the upper case section having a rear surface and an opposing front surface, the front surface comprising a dial face, the upper case section operable to swing on the hinge between open and closed positions, the lower case section having an activation button that is exposed when the upper case section is in the open position, the rear surface of the upper case section disposed adjacent the activation button when the upper case section is in the closed position, the rear surface of the upper case section operable to move toward the activation button when pressure is applied to the dial face, the lower case section housing a wireless transmitter operable to be activated by the activation button when the rear surface of the upper case section presses the activation button, the wireless transmitter for transmitting a wireless emergency signal when activated, the combination of the wristwatch with a removable interference bracket attached to the upper case section, the bracket having a tab extending outwardly from the upper case section, the tab having an exposed lower surface upon which pressure may be applied to lift the upper case section toward the open position.

5. The combination of claim 4 wherein the bracket is disposed between the upper case section and the lower case section, the bracket for contacting the lower case section when the upper case section is in the closed position, the contacting of the bracket against the lower case section preventing further movement of the upper case section toward the lower case section when pressure is applied to the dial face, the bracket thereby preventing the rear surface of the upper case section from pressing against the activation button when pressure is applied to the dial face, the bracket thereby preventing inadvertent activation of the wireless transmitter.

6. A combination personal time-keeping device and emergency signaling device, comprising:

a lower case section for housing a wireless emergency transmitter, the lower case section having an upper surface with a transmitter activation button mounted therein, the transmitter operable to be activated by pressure upon the transmitter activation button;

an upper case section pivotally attached to the lower case section, the upper case section having a rear surface and an opposing front surface comprising a dial face, the upper case section operable to move relative to the lower case section from a closed position to an open position; and interference means for preventing the rear surface of the upper case section from pressing the activation button when pressure is applied to the dial face, thereby preventing inadvertent activation of the transmitter.

7. The combination personal time-keeping device and emergency signaling device of claim 6, wherein the interference means further comprise a removable interference bracket attached to the upper case section and disposed between the upper case section and the lower case section, the bracket having a tab for contacting the lower case section when the upper case section is in the closed position, the contacting of the tab against the lower case section preventing the rear surface of the upper case section from pressing the activation button when pressure is applied to the dial face.

8. The combination personal time-keeping device and emergency signaling device of claim 7, wherein the bracket includes a tab extending outwardly from between the upper case section and the lower case section, the tab having an exposed lower surface upon which pressure may be applied to move the upper case section toward the open position.

9. The combination personal time-keeping device and emergency signaling device of claim 6, wherein the interference means further comprise a removable back cover on the upper case section, the back cover having an outer surface corresponding to the rear surface of the upper case section, the back cover having a tab extending outwardly from an edge thereof, the tab for contacting the lower case section when the upper case section is in the closed position, the contacting of the tab against the lower case section preventing the rear surface of the upper case section from pressing the activation button when pressure is applied to the dial face.

10. The combination personal time-keeping device and emergency signaling device of claim 9, wherein the tab has an exposed lower surface upon which pressure may be applied to lift the upper case section toward the open position.

11. The combination personal time-keeping device and emergency signaling device of claim 6, wherein the interference means further comprise a tab extending outwardly from the upper case section, the tab for contacting the lower case section when the upper case section is in the closed position, the contacting of the tab against the lower case section preventing the rear surface of the upper case section from pressing the activation button when pressure is applied to the dial face.

12. The combination personal time-keeping device and emergency signaling device of claim 11, wherein the tab has an exposed lower surface upon which pressure may be applied to lift the upper case section toward the open position.

* * * * *